United States Patent [19]

Lewis et al.

[11] 4,303,631

[45] Dec. 1, 1981

[54] PROCESS FOR PRODUCING CARBON FIBERS

[75] Inventors: Richard T. Lewis, Parma; Irwin C. Lewis, Strongsville, both of Ohio

[73] Assignee: Union Carbide Corporation, New York, N.Y.

[21] Appl. No.: 163,141

[22] Filed: Jun. 26, 1980

[51] Int. Cl.[3] ..... D01F 9/14; C10C 3/00

[52] U.S. Cl. ..... 423/447.1; 208/39; 208/44; 264/29.2; 423/447.4; 423/447.6

[58] Field of Search ..... 423/447.1, 447.4, 447.6, 423/448, 449, 445; 208/39, 44; 264/29.2

[56] References Cited

U.S. PATENT DOCUMENTS

| | | | |
|---|---|---|---|
| 3,919,387 | 11/1975 | Singer | 423/447.1 X |
| 3,974,264 | 8/1976 | McHenry | 423/447.4 |
| 3,976,729 | 8/1976 | Lewis et al. | 423/447.8 |
| 3,995,014 | 1/1976 | Lewis | 423/447.4 |
| 4,005,183 | 1/1977 | Singer | 423/447.2 |
| 4,032,430 | 6/1977 | Lewis | 208/39 |
| 4,209,500 | 6/1980 | Chwastiak | 423/447.6 |

*Primary Examiner*—Edward J. Meros
*Attorney, Agent, or Firm*—David Fink

[57] ABSTRACT

A process for producing a carbon fiber features converting a precursor material under atmospheric pressure with heat but without sparging to a predetermined mesophase containing pitch, and thereafter continuing the heat treatment with sparging.

20 Claims, No Drawings

PROCESS FOR PRODUCING CARBON FIBERS

The invention relates to a process for producing a carbon filter.

It is well known that carbon fibers having excellent properties suitable for commercial exploitation can be produced from mesophase pitch. The mesophase pitch derived carbon fibers are light weight, strong, stiff, electrically conductive, and both chemically and thermally inert. The mesophase derived carbon filters perform well as reinforcements in composites and have found use in aerospace applications and quality sporting equipment.

Generally, carbon fibers have been primarily made commercially from three types of precursor materials: rayon, polyacrylonitrile (PAN), and pitch. The use of pitch as a precursor material is attractive economically.

Low cost carbon fibers produced from isotropic pitch exhibit little preferred molecular orientation and relatively poor mechanical properties.

In contrast, carbon fibers produced from mesophase pitch exhibit high preferred molecular orientation and relatively excellent mechanical properties.

As used herein, the term "pitch" is to be understood as used in the instant art and generally refers to a carbonaceous residue consisting of a complex mixture of primarily aromatic organic compounds which are solid at room temperature and exhibit a relatively broad melting or softening temperature range. When cooled from the melt, the pitches solidfy without crystallization.

As used herein, the term "mesophase" is to be understood as used in the instant art and generally is synonymous with liquid crystal. That is, a state of matter which is intermediate between crystalline solid and an isotropic liquid. Ordinarily, material in the mesophase state exhibits both anisotropic and liquid properties.

As used herein, the term "mesophase pitch" is a pitch containing more than about 40% by weight mesophase and is capable of forming a continuous anisotropic phase when dispersed by agitation or the liek in accordance with the prior art.

As used herei, the term "mesophase containing pitch" is pitch containing less than about 40% by weight mesophase and the non-mesophase portion or isotropic phase is the continuous phase.

A conventional method for preparing mesophase pitch suitable for forming a highly oriented carbon fiber is through the use of a precursor pitch and includes thermal treatment at a temperature greater than about 350° C. to effect thermal polymerization. This process produces large molecular weight molecules capable of forming mesophase.

The criteria for selecting a suitable precursor material for the conventional method is that the precursor pitch under quiescent conditions forms a homogenous bulk mesophase pitch having large coalesced domains. The domains of aligned molecules are in excess of about 200 microns. This is set forh in the U.S. Pat. No. 4,005,183 to Singer.

A typical conventional method is carried out using reactors maintained at about 400° C. for from about 10 to about 20 hours. The properties of the final material can be controlled by the reaction temperature, thermal treatment time, and volatilization rate. The presence of the high molecular weight fraction results in a melting point of the mesophase pitch of at least about 300° C. An even higher temperature is needed to transform the mesophase pitch into fibers which is termed "spinning" in the art.

The following patents are representative of the prior art and are incorporated herein by reference:

U.S. Pat. No. 4,005,183 to Singer, U.S. Pat. No. 3,919,387 to Singer, U.S. Pat. No. 4,032,430 to Lewis, U.S. Pat. No. 3,976,729 to Lewis et al, U.S. Pat. No. 3,995,014 to Lewis, U.S. Pat. No. 3,974,264 to McHenry, and U.S. Pat. No. 4,209,500 to Chwastiak.

The aforementioned U.S. Pat. No. 3,974,264 to McHenry is of particular interest because it describes the prior art, with respect to its filing date of Oct. 31, 1974, as carrying out the heat treatment of a precursor pitch in the absence of sparging with non-reactive gas. The patent teaches the surprising economy by the use of continuous sparging throughout the heat treatment because the reaction time can be reduced to as little as one-half the time previously required.

In particular, the aforementioned U.S. Pat. No. 3,974,264 stresses the necessity of removing volatile low molecular weight by-products because their pressure has been found to impede the formation of mesophase by the more reactive molecules. The patent also teaches that because of their small size and low aromaticity, the polymerization by-products of the low molecular weight molecules are not readily compatible with the higher molecular weight, more aromatic molecules present in the mesophase portion of the pitch, and the lack of compatibility between these high and low molecular weight molecules adversely affects the rheology and spinnability of the pitch.

The amount of mesophase in a pitch can be evaluated by known methods using polarized light microscopy. The presence of homogeneous bulk mesophase regions can be visually observed by polarized light microscopy, and quantitatively determined by the method disclosed in the aforementioned Chwastiak patent. Previously, the criteria of insolubility in certain organic solvents such as quinoline and pyridine was used to estimate mesophase content.

There could be present in the precursor pitch certain non-mesophase insolubles and it is a common practice to remove these insolubles before treating the precursor pitch to transform it to mesophase pitch.

The polarized light microscopy method can also be used to measure the average domain size of a mesophase pitch. For this purpose, the average distance between disclination lines is measured and defined as the average domain size. As used herein, domain size is measured at room temperature for samples which has been quiescently heated to about 400° C.

One of the principal objects of the invention is a process for producing a carbon fiber, comprising the steps of converting a selected precursor material into a mesophase pitch, spinning the mesophase pitch into at least one pitch fiber, and converting the pitch fiber into a carbon fiber; and featuring the improvement of converting the precursor material into a mesophase containing pitch by a first heat treatment of the precursor material with agitation but without sparging at about atmospheric pressure in a non-reactive gaseous environment until a preliminary pitch having a mesophase content from about 20% to about 50% by weight is obtained, and thereafter a second heat treatment of the preliminary pitch at about atmospheric pressure with both agitation and sparging with a non-reactive gas until a mesophase pitch having a mesophase content of at least 70% by weight is obtained.

Preferably, the process is carried out so that the first heat treatment produces a preliminary pitch having a mesophase content of from about 30% to about 40% by weight. More preferably, the first treatment is carried out at a temperature sufficient to polymerize the precursor material such as a temperature in the range of from about 350° to about 450° C.

In accordance with the prior art, "% P.I." refers to pyridine insolubles of a pitch by Soxhlet extraction in boiling pyridine at about 115° C.

Softening point or softening temperature of a pitch, is related to its molecular weight constitution. The presence of a large amount of high molecular weight components generally tends to raise the softening temperature. It is a common practice in the art to characterize in part a precursor pitch by its softening point. For mesophase pitches, the softening point is used to determine suitable spinning temperature. Generally, the spinning temperature is about 40° C. or more higher than the softening temperature.

Generally, there are several methods for determining the softening temperature and the temperatures measured by these different methods vary somewhat from each other.

Generally, the Mettler softening point procedure is widely accepted as the standard for evaluating precursor pitches. This procedure can be adapted for use on mesophase pitches.

The softening temperature of a mesophase pitch can also be determined by hot stage microscopy. In this method, the mesophase pitch is heated on a microscope hot stage in an inert atmosphere. The temperature of the mesophase pitch is raised under a controlled rate and the temperature at which the mesophase pitch commences to deform is noted as the softening temperature.

As used herein, softening point or softening temperature will refer to the temperature determined by the Mettler procedure for both precursor and mesophase phase pitches.

Preferably, the precursor material is selected from the group consisting of coal tar pitches, petroleum pitches, coal tars, petroleum derived thermal tars, decant oils derived from catalytic cracking of petroleum fractions, ethylene tars, high boiling distillates derived from coal tars and ethylene tars, high boiling gas oils derived from petroleum refining, and high boiling polynuclear aromatic hydrocarbons.

More preferably, the precursor material has a Mettler softening point greater than about 80° C. and is selected from the group consisting of coal tar pitches and petroleum pitches.

The precursor materials suitable for the invention have been designated by terms used and accepted in the art. For the sake of further clarification, some additional comments with respect to the various precursor materials are given.

The term "coal tar" is used to designate the material which is the overhead product from the production of metallurgical coke from coal. Coal tar pitch is made from coal tar by distilling off the low boiling components. Coal tar contains infusible particles which are removed before the production of a mesophase pitch suitable for carbon fibers.

"Decant oils derived from catalytic cracking of petroleum fractions" relates to a catalytic cracking in which various distillate materials, mainly virgin gas oils, are fed to the reactor containing the catalyst. The overhead products from the reactor ar condensed and separated in a fractionator. The highest boiling fraction of the overhead products (sometimes referred to as the "bottoms") is the precursor of decant oil. This high boiling fraction contains entrained catalyst particles which can be removed. Decant oil is the liquid material which has been separated from the catalyst particles. Synonyms for "decant oil" are "slurry oil", or "clarified slurry oil", and "syntower bottoms".

"Ethylene tar" is the material which is the "bottoms" product from the fractionator used to separate the liquid by-products in an olefins plant. Olefins are produced by vapor phase, steam-cracking of ethane liquified petroleum gas, naphtha, gas oils or crude oils. Several of these feedstocks may be used at the same time in a given olefins plant. Some ethylene tars contain carbonaceous solids which are removed before making mesophase pitch. Synonyms for the ethylene tars are "pyrolysis tar", "pyrolysis fuel oil", "quench oil", "ethylene plant bottoms", "naphtha steam-cracking residues" or "gas oil steam-cracking residues".

"Petroleum-derived thermal tar" relates to the least volatile fraction of the product from liquid phase thermal cracking. Feedstocks, such as virgin or coker gas oils, or decant oils, are heat treated under pressure. The products are partially condensed and separated in a fractionator. Middle distillates are usually recycled and gasoline, gas, and thermal tar are net products.

"High-boiling distillates derived from ethylene tars" are produced by fractionating a wide boiling range ethylene tar into one or more distillate cuts and a bottoms product. These high-boiling distillates as used herein are each characterized by no more than about 50% by weight being capable of being vaporized at about 400° C. at atmospheric pressure, and preferably more than about 80% by weight boils at more than about 400° C. at atmospheric pressure.

"High-boiling distillates derived from coal tars" are produced by fractionating a wide boiling range coal tar into one more distillates cuts and a bottoms product. These high-boiling distillates as used herein are each characterized by no more than about 50% by weight being capable of being vaporized at about 400° C. at atmospheric pressure and preferably, more than about 80% by weight boils at more than about 400° C. at atmospheric pressure.

"High-boiling gas oils derived from petroleum refining" or "gas oil" is a general term often used to describe the distillates produced in petroleum refining. For example, virgin gas oils are distillates from the fractionation of crude oil. Vacuum gas oils are the distillates produced in a distillation conducted under a vacuum. Vacuum gas oils are usually high-boiling because the feedstock is often a bottoms product from an atmospheric pressure distillation. Coker gas oils are distillates produced from a fractionation of the overhead from a coking operation. The high-boiling gas oils as used herein are each characterized by no more than about 50% by weight being capable of being vaporized at about 400° C. at atmospheric pressure and preferably, more than about 80% by weight boils at more than about 400° C. at atmospheric pressure.

"High-boiling polynuclear aromatic hydrocarbons" have a boiling point above about 400° C. which would be the reaction temperature for the first stage heat treatment according to the invention.

Preferably, the sparging is carried out at a rate of at least 4.0 scfh per pound of precursor material and generally from about 1.5 to 10.0 scfh per pound of precusor material.

As used herein, a non-reactive gas is a gas which substantially does not react with the pitch at the operative temperatures.

Preferably, the sparging is carried out with a non-reactive gas selected from the group consisting of nitrogen, argon, carbon dioxide, helium, methane, carbon monoxide, and steam.

Another principal object of the invention is a process for producing a mesophase pitch comprising the steps of converting a selected precursor material into a preliminary pitch by a first heat treatment of the precursor material with agitation but without sparging at about atmospheric pressure in an inert gaseous environment until the preliminary pitch having a mesophase content of from about 20% to about 50% by weight is obtained; and thereafter, a second heat treatment of said preliminary pitch at about atmospheric pressure with both agitation and sparging with a non-reactive gas until a mesophase pitch having a mesophase content of at least 70% by weight is obtained.

The various preferred embodiments for the process of producing the mesophase pitch correspond to the preferred embodiments for producing a carbon fiber.

Further objects and advantages of the invention will be set forth, in part, in the following specification and, in part, will be obvious therefrom without being specifically referred to.

Illustrative, non-limiting examples of the invention are set out below. Numerous other examples can readily be evolved in the light of the guiding principles and teaching herein.

The examples given herein are intended to illustrate the invention and not in any sense to limit the manner in which the invention can be practiced. The parts and percentages recited herein, unless specifically stated otherwise, referred to parts by weight and percentages by weight.

EXAMPLE 1

A commercially available petroleum pitch having a softening point of 130° C. was heated to a temperature of from about 200° C. to about 250° C. in a stainless steel reaction vessel while nitrogen was introduced at a low flow rate into the vapor space above the pitch to prevent oxidation of the pitch. After the pitch had melted, it was agitated with a mechanical stirrer at the rate of 300 rpm and the temperature was raised to about 420° C. uniformly over a period of approximately one hour. The heat treatment was continued for a period of about five hours in a temperature range of about 420° C. to about 425° C. This heat treatment was carried out at atmospheric pressure.

The resulting preliminary pitch constituted about a 90% yield and had the following properties:

290° C.—Mettler softening point
40—% P.I.
40%—mesophase (polarized light microscopy)
74%—Conradson carbon content The preliminary pitch was then subjected to a heat treatment at atmospheric pressure in a reaction vessel of a period of about six hours at a temperature of about 390° C. while being agitated at the rate of about 300 rpm and continuously sparged with argon at a rate of about 8 scfh/lb. The mesophase pitch obtained constituted about 72% yield and exhibited the following properties:

345° C.—Mettler softening point
54—% P.I.
88%—mesophase content (polarized light microscopy)
90%—Conradson carbon content The overall yield of the mesophase pitch as compared to the precursor material was about 65%.

The mesophase pitch was spun into monofilament fibers having a diameter of about 15 microns which were thermoset by heating in air at 2° C. per minute to about 375° C. and thereafter carbonized to 1700° C. in an inert atmosphere in accordance with conventional methods. The carbon fibers obtained exhibited excellent properties. The spinnability of the mesophase pitch into fibers was also excellent.

For comparison, the same precursor material was converted to mesophase pitch using a conventional process. The precursor pitch was heat treated at atmospheric pressure with agitation for about 27 hours at a temperature of about 390° C. while it was sparged continuously with argon gas at a rate of about 5 scfh/lb. The yield of the mesophase pitch obtained was about 47% and had the following properties:

345° C.—Mettler softening point
53—% P.I.
95%—mesophase content (polarized light microscopy)

The instant invention as compared to the conventional process resulted in a substantial improvement in the yield and still resulted in a substantially high mesophase content.

EXAMPLE 2

A coal tar pitch having a softening point of about 130° C. was heat treated at atmospheric pressure for a period of about twenty-one hours at a temperature of about 390° C. while agitating at the rate of about 300 rpm and a slow flow of argon gas was maintained above the reaction vessel to prevent oxidation. The preliminary pitch obtained had an estimated mesophase content of about 30%.

The next treatment was carried out at atmospheric pressure at a temperature of about 390° C. for an additional 3.5 hours while sparging continuously with argon at a rate of about 8 scfh/lb. The mesophase pitch was obtained in an overall 76% yield an had the following properties:

342° C.—Mettler softening point
65—% P.I.
85%—mesophase content (polarized light microscopy)

For comparison, the same precursor material was heated in the reaction vessel for a period of about 18 hours at a temperature of about 393° C. while continuously sparging with argon at the rate of about 4 scfh/lb. in accordance with the prior art. The mesophase pitch obtained constituted a 62% yield, had a softening point of 348° C., and had a mesophase content of about 95%.

It can be seen that the process according to the instant invention resulted in a greater yield of a high mesophase content mesophase pitch.

EXAMPLE 3

A second commercially available petroleum pitch having a softening of about 122° C. was heat treated for a period of about 10 hours at atmospheric pressure in the presence of steam at a temperature of about 400° C. with agitation to obtain a preliminary pitch having a mesophase content of about 25%.

Thereafter, the preliminary pitch was heat treated for a period of about 7 hours at atmospheric pressure at a temperature of about 380° C. while being sparged continuously with steam at the rate of about 1.6 scfh/lb. while agitating. This heat treatment was continued another 4 hours at a temperature of about 390° C. and then for about 1 hour at a temperature of about 404° C. The mesophase pitch obtained constituted an overall yield of about 70% and had a softening point of 325° C. and contained about 82% mesophase.

For comparison, the precursor pitch was heat treated for a period of about 12 hours at a temperature of about 400° C. with agitation and steam sparging at the rate of about 1.3 scfh/lb. in accordance with conventional processes. The mesophase pitch obtained constituted a yield of about 41%, at a softening point of about 318° C. and contained 84% mesophase.

The instant invention shows a substantial improvement in yield for a mesophase pitch having a high mesophase content.

EXAMPLE 4

A commercially available petroleum pitch having a softening point of about 125° C. was heat treated for a period of about 14 hours at atmospheric pressure at a temperature of about 400° C. with agitation in steam atmosphere. A preliminary pitch having a mesophase content of about 30% was obtained.

Thereafter, the heat treatment was carried out for a period of about 7 hours at atmospheric pressure at a temperature of about 400° C. with agitation and sparging continuously with steam at a rate of about 1.4 scfh/lb. The mesophase pitch obtained constituted an overall yield of about 66% and had the following properties:

330° C.—Mettler softening point

53—% P.I.

87%—mesophase content (polarized light microscopy)

The mesophase pitch was spun into multifilament fibers having a diameter of about 15 microns.

For comparison, the precursor material was converted to mesophase pitch using a conventional process with sparging at about a temperature of about 400° C. and the yield was about 40%.

EXAMPLE 5

The precursor material of Example 4 was heated from room temperature to about 410° C. over a period of about 1.5 hours and then heated at atmospheric pressure at a temperature of about 410° C. for a period of about 14 hours with agitation in a steam environment. The preliminary pitch obtained had a mesophase content of about 40%.

Thereafter, the preliminary pitch was heat treated for a period of about 8 hours at atmospheric pressure at a temperature of about 410° C. while being sparged continuously with steam at a rate of about 1.8 scfh/lb. with agitation. The mesophase pitch obtained constituted an overall yield of about 63% and had the following properties:

365° C.—Mettler softening point

63—% P.I.

100%—mesophase content (polarized light microscopy)

The mesophase pitch showed excellent spinnability when it was spun into monofilament fibers having a diameter of about 15 microns.

For comparison, a conventional process was carried out to convert the precursor material into a mesophase pitch while sparging with steam throughout the heat treatment until the mesophase pitch obtained exhibited a Mettler softening point of about 365° C. as in the foregoing case. The yield was about 40%.

We wish it to be understood that we do not desire to be limited to the exact details set forth herein, for obvious modifications will occur to a person skilled in the art.

What is claimed is:

1. A process for producing a carbon fiber, comprising the steps of converting a selected precursor material into a mesophase pitch, spinning the mesophase pitch into at least one pitch fiber, and converting the pitch fiber into a carbon fiber; wherein the improvement comprises:

converting said precursor material into a mesophase containing pitch by a first heat treatment of said precursor material with agitation but without sparging at about atmospheric pressure in a non-reactive gaseous environment until a preliminary pitch having a mesophase content from about 20% to about 50% by weight is obtained; and thereafter, a second heat treatment of said preliminary pitch at about atmospheric pressure with both agitation and sparging with a non-reactive gas until a mesophase pitch having a mesophase content of at least 70% by weight is obtained.

2. The process of claim 1, wherein said first heat treatment is carried out so that said preliminary pitch has a mesophase content of from about 30% to about 40% by weight.

3. The process of claim 1, wherein said first heat treatment is carried out at a temperature sufficient to polymerize said precursor material.

4. The process of claim 3, wherein said temperature is in the range of from about 350° C. to about 450° C.

5. The process of claim 1, wherein said precursor material is selected from the group consisting of coal tar pitches, petroleum pitches, coal tars, petroleum derived thermal tars, decant oils derived from catalytic cracking of petroleum fractions, ethylene tars, high boiling distillates derived from coal tars and ethylene tars, high boiling gas oils derived from petroleum refining, and high boiling polynuclear aromatic hydrocarbons.

6. The process of claim 1, wherein said precursor material has a Mettler softening point greater than about 80° C. and is selected from the group consisting of coal tar pitches and petroleum pitches.

7. The process of claim 1, wherein said sparging is carried out at a rate of at least 1.0 scfh per pound of precursor material.

8. The process of claim 1, wherein said sparging is carried out at a rate of from about 1.5 scfh to about 10.0 scfh per pound of precursor material.

9. The process of claim 1, wherein said sparging is carried out with a gas selected from the group consisting of nitrogen, argon, carbon dioxide, helium, methane, carbon monoxide and steam.

10. The process of claim 1, wherein said sparging is carried out at a rate of about 4.0 scfh per pound of precursor material.

11. A process for producing a mesophase pitch, comprising the steps of:

converting a selected precursor material into a preliminary pitch by a first heat treatment material with agitation but without sparging at about atmospheric pressure in a non-reactive gaseous environment until said preliminary pitch having a mesophase content from about 20% to about 50% by weight is obtained; and thereafter, a second heat treatment of said preliminary pitch at about atmospheric pressure with both agitation and sparging with a non-reactive gas until a mesphase pitch having a mesophase content of at least 70% by weight is obtained.

12. The process of claim 11, wherein said first heat treatment is carried out so that said preliminary pitch has a mesophase content of about from 30% to about 40% by weight.

13. The process of claim 11, wherein said first heat treatment is carried out at a temperature sufficient to polymerize said precursor material.

14. The process of claim 13, wherein said temperature is in the range of from 350° C. to about 450° C.

15. The process of claim 11, wherein said precursor material is selected from the group consisting of coal tar pitches, petroleum pitches, coal tars, petroleum derived thermal tars, decant oils derived from catalytic cracking of petroleum fractions, ethylene tars, high boiling distillates derived from coal tars and ethylene tars, high boiling gas oils derived from petroleum refining, and high boiling polynuclear aromatic hydrocarbons.

16. The process of claim 12, wherein said precursor material has a Mettler softening point greater than about 80° C. and is selected from the group consisting of coal tar pitches and petroleum pitches.

17. The process of claim 11, wherein said sparging is carried out at a rate of at least 1.0 scfh per pound of precursor material.

18. The process of claim 11, wherein said sparging is carried out at a rate of from about 1.5 scfh to about 10.0 scfh per pound of precursor material.

19. The process of claim 11, wherein said sparging is carried out with a gas selected from the group consisting of nitrogen, argon, carbon dioxide, helium, methane, carbon monoxide and steam.

20. The process of claim 11, wherein said sparging is carried out at a rate of about 4.0 scfh per pound of precursor material.

* * * * *

UNITED STATES PATENT AND TRADEMARK OFFICE

CERTIFICATE OF CORRECTION

PATENT NO. : 4,303,631

DATED : Dec.1, 1981

INVENTOR(S) : Richard T. Lewis and Irwin C. Lewis

It is certified that error appears in the above—identified patent and that said Letters Patent is hereby corrected as shown below:

Col.1,line 2, change "filter" to --fiber--;
line 11, change "filters" to --fibers--;
line 41, change "liek" to --like--;
line 43, change "herei" to --herein--;
line 59, change "forh" to --forth--.

Col.3,line 39, cancel "phase";
line 68, change "ar" to --are--.

Col.5,line 62, change "of" to --for--.

Signed and Sealed this

Sixth Day of April 1982

[SEAL]

*Attest:*

GERALD J. MOSSINGHOFF

*Attesting Officer* *Commissioner of Patents and Trademarks*